United States Patent [19]

Barton

[11] Patent Number: 4,748,548

[45] Date of Patent: May 31, 1988

[54] LIGHTING FIXTURE

[76] Inventor: Daniel W. Barton, 17170 Courtney La., Huntington Beach, Calif. 92649

[21] Appl. No.: 861,599

[22] Filed: May 9, 1986

[51] Int. Cl.[4] ..... F21V 21/00

[52] U.S. Cl. ..... 362/249; 362/370; 362/430

[58] Field of Search ..... 362/247, 249, 250, 125, 362/151, 374, 375, 287, 347, 33, 430, 219, 220, 223, 133, 285, 368

[56] References Cited

U.S. PATENT DOCUMENTS

| | | | |
|---|---|---|---|
| 1,513,933 | 8/1926 | Riddle | 362/247 |
| 4,164,009 | 8/1979 | Maguire et al. | 362/371 |
| 4,574,336 | 3/1986 | Mikalonis | 362/223 |
| 4,598,341 | 7/1986 | Brackhahn et al. | 362/249 |

FOREIGN PATENT DOCUMENTS

| | | | |
|---|---|---|---|
| 1552041 | 11/1968 | France | 362/370 |
| 85/05433 | 12/1985 | PCT Int'l Appl. | 362/249 |

*Primary Examiner*—William A. Cuchlinski, Jr.
*Assistant Examiner*—D. M. Cox
*Attorney, Agent, or Firm*—Singer & Singer

[57] ABSTRACT

A linear lighting fixture primarily adapted for use with low voltage halogen lamps. The main fixture comprises a substantially U-shaped cross-section member having a pair of longitudinal ridges near the extremities and a plurality of identical light modules capable of being removably inserted at different portions on the elongated housing. Each light module comprises a bulb, a socket, lens and mounting clips for holding the light module onto the housing by means of the longitudinal ridges located on the housing. The housing is supported by additional clips having channeled end portions that also lock into the longitudinal ridges located on the housing. The individual light modules may be removed without disturbing the housing or the housing mountings. The lighting fixture is highly adaptable for providing high intensity spotlighting or flood lighting by simply adding or removing additional light modules.

16 Claims, 4 Drawing Sheets

Fig. 7.
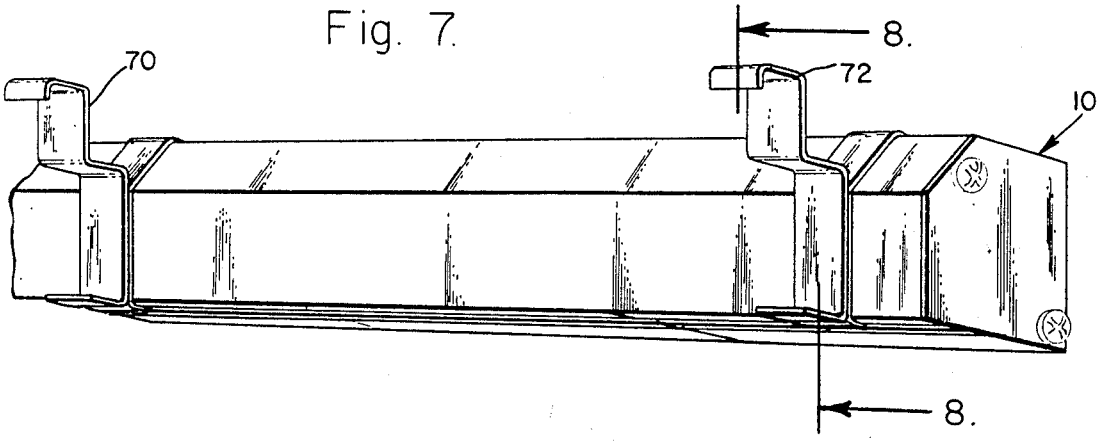
Fig. 5.
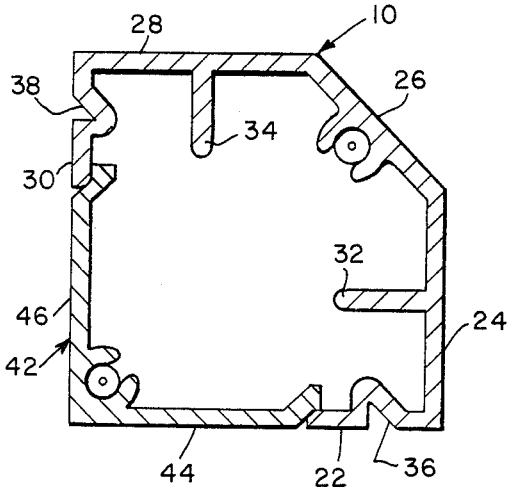
Fig. 8.
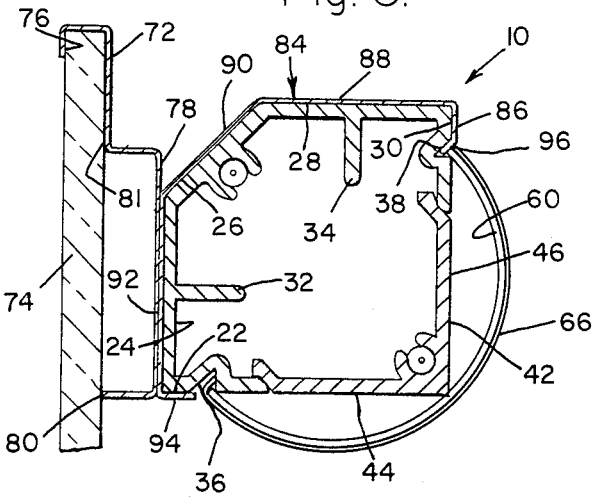
Fig. 11.
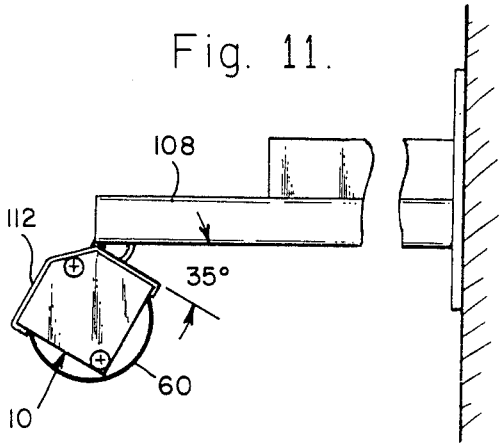
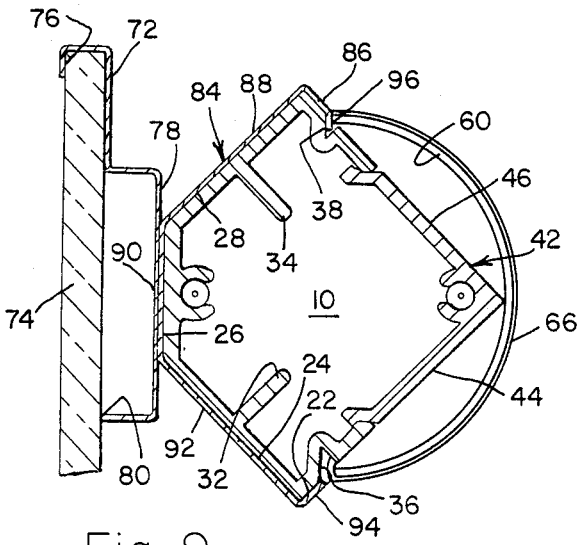
Fig. 9.

LIGHTING FIXTURE

This invention relates to a lighting fixture and more particularly to a lighting fixture primarily adapted for use with a high intensity light source that provides a long linear low profile capable of being used for decorative lighting, spotlighting, backlighting and general lighting.

It is generally recognized in the art today that lighting is very important in the selling fields, whether it be shoes, fresh fruit, jewelry or even clothing. Tests have indicated that improving the lighting in a showcase invariably results in higher sales when compared with average or sub-par lighting A display fixture by its very nature has a limited area for displaying the goods of a merchant and as a result the space available for providing sufficient lighting is usually limited. In order to accommodate the limited space available, present day lighting fixtures have been primarily limited to the use of fluorescent tubes which by their nature are long and thin and hence require a minimum of space. Unfortunately, fluorescent tubes do not provide a very bright light and by the very nature of the elongated tube there is no convenient way to provide a spotlight on specific goods as opposed to generating an area of constant illuminated light.

It is generally known that incandescent lights operating at full line voltage can generate sufficient light except that such fixtures operating at full line voltage tend to be large and bulky because of the associated heat generated by the lighting fixture. Incandescent lights invariably have found more favor as a spotlight operating from a remote location, usually located far removed from the counter or cabinet which requires full illumination.

Electrical underwriting requirements for full line voltage incandescent light sources usually require a large container for heat dissipation, thereby precluding their use in a small cabinet such as a jewelry case or similar showcase.

The prior art discloses many lighting fixtures primarily adapted for use with elongated fluorescent tubes and the like. Fixtures of this type are smaller and convenient but unfortunately do not provide sufficient light required by present day merchants.

For example, U.S. Pat. No. 4,158,221, entitled Light Fixture, discloses a fixture for using a plurality of tubular electrical lamps capable of use in display cases, bookshelves and the like.

An earlier U.S. Pat. No. 1,137,378, entitled Showcase Light, discloses still another form of mounting an elongated tubular light in a housing, which housing has grooves on the periphery, thereby allowing the housing to be located in different preferred positions.

Another showcase lighting fixture includes British Patent No. 28,723 which discloses an open channel lighting fixture for holding elongated lamps in a preferred position.

In the present invention there is described a fixture primarily adapted to use a high intensity light source such as a halogen lamp and in a fixture that allows the light to be used as a spotlight or as a high intensity floodlight source depending only upon the needs of the user.

The lighting fixture comprises an elongated housing of generally U-shaped cross-section that preferably has five planer surfaces consisting of a pair of identical right angle members, each having a short side and a long side, and in which each of said long sides are connected to a common fifth side at 45° with both of the short sides substantially facing each other.

A pair of elongated ribs connected to the long sides of each pair of identical right angle members are included for strengthening the housing.

The short sides of the housing each contain grooves extending longitudinally the length of the housing. The grooves are an important function of the invention since they serve the dual purpose of accepting an external lens that is easily removable by the user but also provide the basis by which the complete housing can be supported by an external clip or clips, depending only upon the needs of the user.

The light source which may include one light module or a plurality of light modules are all identical and each consists of an L-shaped cross-section member having two equal length arms that are adapted to nest within the U-shaped cross-section of the housing member in a holding relationship. Each L-shaped member contains a central cut-out for accepting a lamp in a lamp socket. The complete light module assembly is simply snapped in place into the housing member wherever a light source is needed or desired. If no light source is desired at a given position, then the L-shaped member without a cut-out is inserted to provide continuity in the housing structure.

A reflector consisting of a concave member is located within the U-shaped housing and rests upon the pair of longitudinal grooves extending within the housing. The reflector is movable in a longitudinal direction and preferably is located directly behind the cut-out in the L-shaped cross-section member.

A removable elongated lens having a semi-circular cross-section is located substantially over the central cut-out in the L-shaped member. The end portions of the lens member is positioned directly within the two grooves located on the elongated housing.

A pair of clips having a semi-circular cross-section and channeled end portions is placed over the elongated lens with the channeled end portions each located within the grooves located on the elongated housing.

The user by removing the clips can easily remove the lens and if necessary change a bulb or replace the lens with a different colored lens or even slide the light module in a longitudinal direction to obtain the light source that is considered more appropriate for the occasion. Once the housing is located in position the light modules are replaced from the outside and the user has complete access to the lamp, the lens and the reflector without dismantling any of the fixed installation members other than to remove two clips holding the elongated lens.

Further objects and advantages of the present invention will be made more apparent by referring now to the accompanying drawings wherein:

FIG. 5 is a cross-sectional view taken along lines 5—5 of FIG. 3.

FIG. 7 is a perspective view illustrating a pair of brackets holding the light fixture;

FIG. 8 is a cross-sectional view taken along lines 8—8 of FIG. 7;

FIG. 9 illustrates a second embodiment for mounting the light fixture on the supporting clips;

FIG. 11 is a side view of FIG. 10 illustrating the support for the light fixture;

Figure 1:
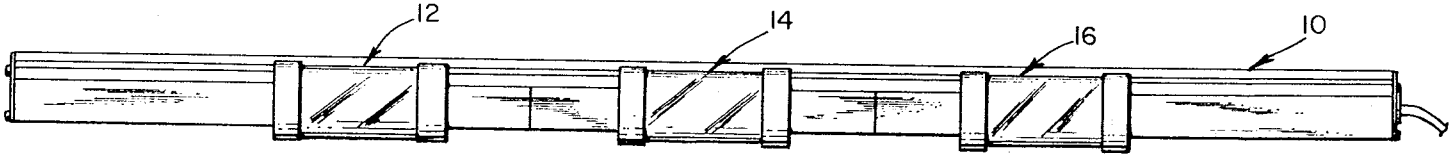
FIG. 1 is a perspective drawing illustrating a lighting fixture constructed according to the present invention having three light modules.

Referring now to FIG. 1, there is shown a light fixture constructed according to the principles of this invention comprising an elongated housing 10 containing three light modules 12, 14 and 16.

The length of the housing 10 is determined by the needs of the user and will usually have a length dictated by either the cabinet bookcase or other external indicia.

Each of the individual light modules 12, 14 and 16 are identical in size and shape and are located on the housing 10.

Figure 2:
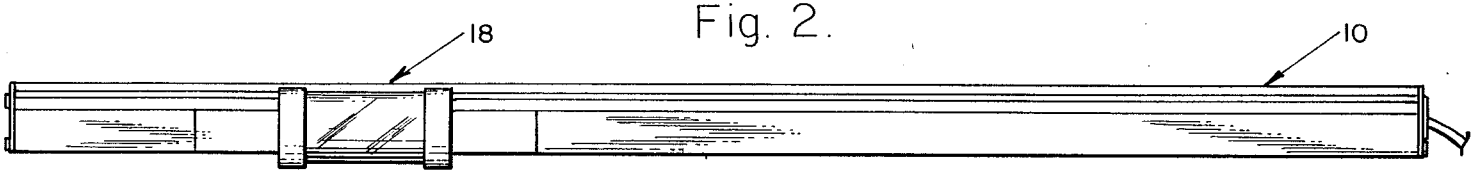
FIG. 2 illustrates a housing similar to FIG. 1 but having only a single light module.

Referring now to FIG. 2, there is shown the housing 10 similar in all respects to housing 10 illustrated in FIG. 1 except that only a single light module 18 is illustrated.

The individual light modules are insertable and replaceable after the housing is in place, which feature allows the user to move the light modules to any location on the housing depending only on the needs of the user. In the usual installation the housing 10 can be fixedly located against the wall or bookcase or it may be hung by means of special clips more fully described and illustrated in connection with FIGS. 7, 8, 9, 10, 11, 12 or 13. In any event, regardless of how the housing is attached or supported, the individual light modules are removable from the front of the housing 10 without moving the housing from its supporting fixtures.

Figure 3:
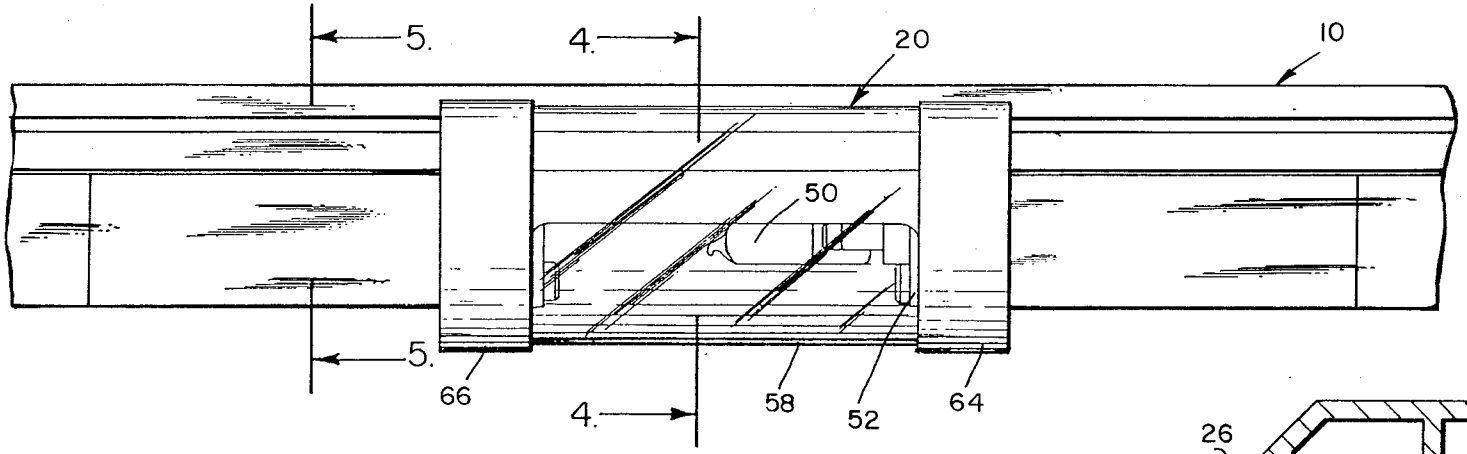
FIG. 3 is an expanded view of a single light module.
Figure 4:
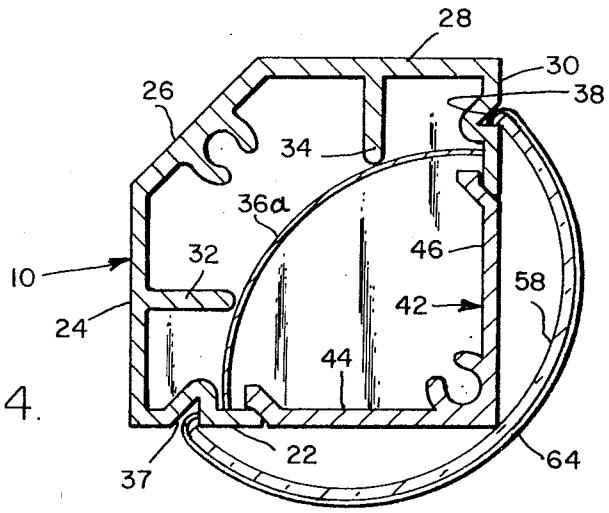
FIG. 4 is a cross-sectional view taken along lines 4—4 of FIG. 3.

Referring now to FIGS. 3, 4 and 5, there is shown an expanded view of a single light module 20 that is identical in all respects to light modules 12, 14 and 16 illustrated in FIG. 1 or light module 18 illustrated in connection with FIG. 2.

Figure 6:
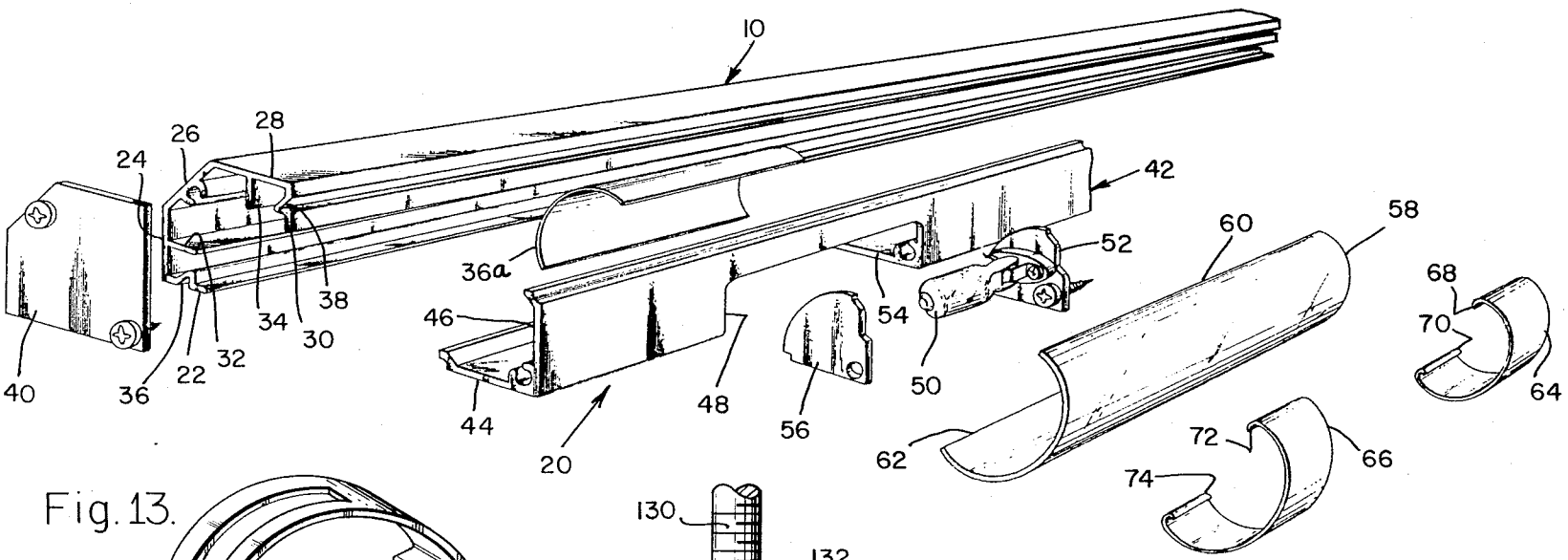
FIG. 6 is an exploded view of a single light module.

The light module 20 illustrated in FIG. 3 will be more fully understood by referring at the same time to the exploded view of FIG. 6 which also illustrates light module 20.

The elongated housing 10 has a generally U-shaped cross-section consisting of five planer sides 22, 24, 26, 28 and 30. Located on planer surfaces 24 and 28 are a pair of identical elongated ribs 32 and 34 extending the length of housing 10. The elongated ribs 32 and 34 provide a dual function of strengthening the housing 10 and also provide a support for a concave reflector 36.

Located on the relatively short planer surfaces 22 and 30 are a pair of grooves 37 and 38 extending longitudinally for the complete length of housing 10.

For cosmetic purposes an end plate 40 is provided at each end of housing 10 for sealing the ends of housing 10 and providing a more aesthetic appearance to viewers.

The individual light modules 20 which are all identical comprise an L-shaped member 42 having two equal length arms 44 and 46. The ends of arms 44 and 46 are adapted to nest within the ends of planer surfaces 22 and 30. The nesting relationship of L-shaped member 42 is such that the member can be removed from housing 10 without disturbing the external support or brackets holding housing 10 in place.

Member 42 contains a central cut-out 48 for supporting a lamp 50 and a lamp socket 52. The combination of lamp 50 and lamp 52 is fixedly attached to one end of the exposed portion 54 formed by the cut-out 48 in member 42. The other exposed end of the cut-out 48 is covered by means of a face plate 56 that is included for aesthetic appearances.

The concave reflector 36*a* is located within the nesting portion of housing 10 and rests upon the protruding ribs 32 and 34 located within the housing. The concave reflector 36*a* may be moved longitudinally and is preferably located directly behind the cut-out 48 located in member 42. Since member 42 may be located at any location longitudinally within the housing 10, it follows that the concave reflector 36*a* would also be moved longitudinally in order to place the reflector directly behind the light source 50. The complete assembly of member 42, light source 50 and bracket 52 may be moved longitudinally along the housing 10 and may also be removed from its nesting relationship within the housing, thereby exposing all the parts as shown in FIG. 6.

A removable lens having a semi-circular cross-section is located directly over the opening 48 in member 42. The end portions 60 and 62 of the lens are adapted to fit directly onto the grooves 38 and 37, respectively, located on planer surfaces 30 and 22 of housing 10. A pair of clips 64 and 66 each having a semi-circular cross-section and containing channeled end portions 68 and 70 and 72 and 74, respectively, are each adapted to fit over the lens 58 and in which channel members 68 and 70 fit within grooves 38 and 36, respectively, while channeled members 72 and 74 of clip 66 fit into grooves 38 and 36, respectively, to thereby hold lens 58 in position on the housing 10.

The lens 58 completely covers the light source 50, thereby satisfying the requirements of the FDA which requires that the light source be covered when illuminating food or food stuffs. For decorative purposes the lens 58 may be of any color and style, thereby allowing the user to effectively and easily change the color and/or the location of the light depending only on the needs of his display case to more properly illuminate the goods on display.

Referring now to FIG. 4, there is shown a section taken along lines 4—4 of FIG. 3 which more fully illustrates the cross-section of the housing 10 and shows the nesting relationship between member 52 within the housing 10 together with the location of the reflector 36*a* and the lens 58.

Referring now to FIG. 5, there is shown a cross-section of FIG. 3 taken along lines 5—5 more fully illustrating the relationship between the housing 10 and the L-shaped member 42. Member 42 is held within the U-shaped cross-section of housing 10 by friction only and is easily removed by the user, thereby allowing easy access to changing the light fixtures or moving the light to any location as determined by the user.

The longitudinal grooves 36 and 38 extending the length of the housing 10 provide a dual function in allowing the housing 10 to be externally supported by suitable clips to be described as well as provide the means for clips 64 and 66 to hold the lens 60 in place.

Referring now to FIG. 7, there is shown a prospective view of an elongated housing 10 being supported and held by a pair of external clips 70 and 72.

FIG. 8 is a section taken along lines 8—8 of FIG. 7 and more fully illustrates clip 72 and how it supports the housing 10.

Referring now to FIGS. 7 and 8, there is shown an elongated housing 10 being supported by a pair of identical clips 70 and 72. Clip 72 more fully shown in connection with FIG. 8 is adapted to hang on a vertical member 74 which may be for example the back of a bookcase or a vertical glass partition forming a jewelry display case. Clip 72 contains a shoulder 76 adapted to fold over the top portion of member 74, thereby allowing the clip 72 to hang in a more vertical position. The opposite end of clip 72 contains a U-shaped portion 78 that abuts on the vertical member 74 at point 80 and 81, respectively.

Attached to clip 72 along the U-shaped member 78 is a spring clip 84 having a generally U-shaped cross-section and comprising five planer surfaces 86, 88, 90, 92 and 94, each in direct contact with the five planer surfaces 30, 28, 26, 24 and 22, respectively, of housing 10.

The end portion of planer surface 86 contains a channel 96 for engaging groove 38 whereas planer surface 94 contains a channel 98 for contacting groove 36. The channeled end portions 96 and 98 effectively hold the housing 10 against the spring clip 84.

Referring now to FIG. 9, there is shown a second embodiment in which planer surface 24 of the housing 10 is fixedly attached to planer surface 78 of the spring clip 72, thereby changing the light projection from the housing 10 as indicated.

Depending on the needs of the user, the planer surface 88 of the housing 10 may be fixedly attached to the planer surface 92 of the clip 72, thereby allowing the user to have the light projected in an upward direction.

Figure 10:
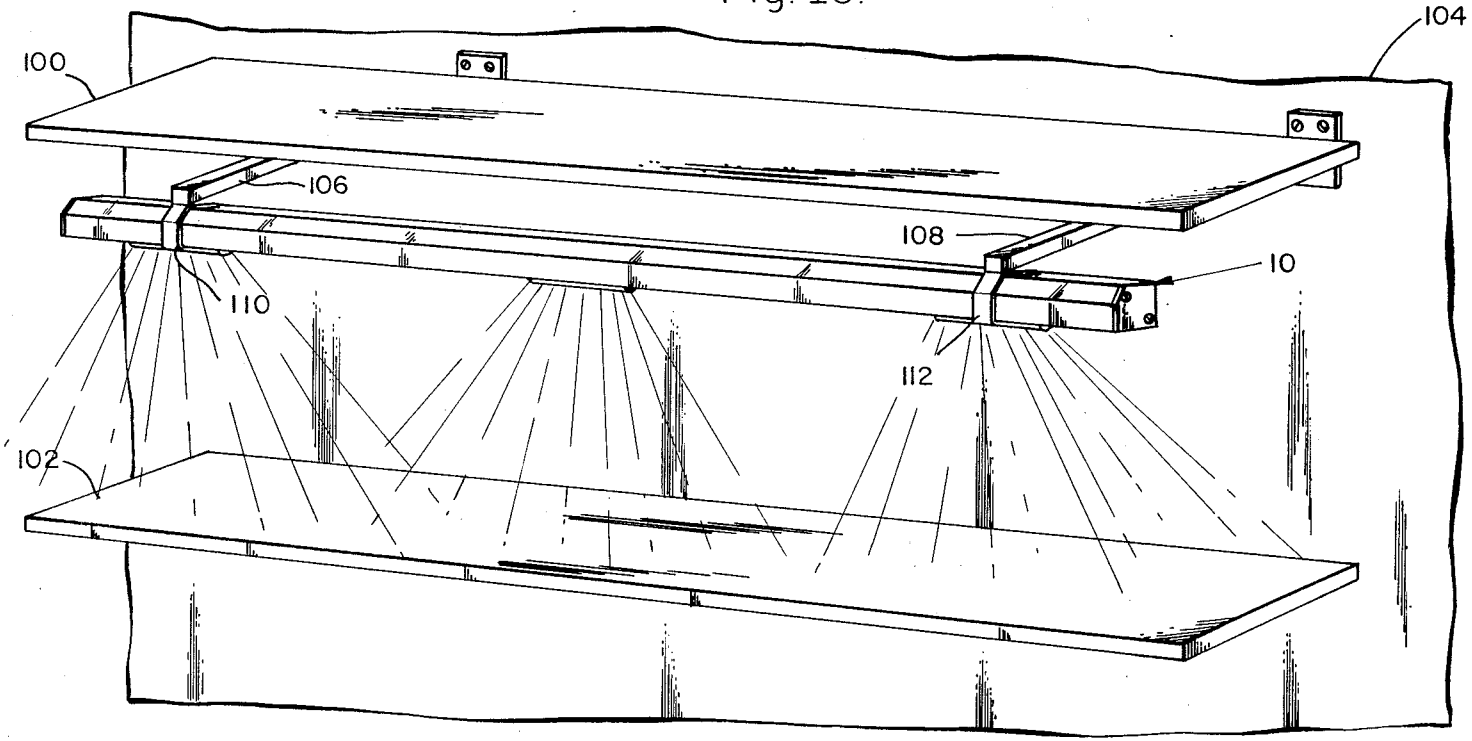
FIG. 10 is a perspective view illustrating still other clamps for supporting the light fixture on a shelf arrangement.

Referring now to FIG. 10, there is shown a perspective drawing illustrating another application of a lighting fixture used in connection with items on shelves.

FIG. 10 illustrates a pair of shelves 100 and 102 supported against a wall portion 104 by means of a pair of brackets 106 and 108. The brackets 106 and 108 are conventional brackets attached to a wallboard for holding shelving. Located at the end portion of brackets 106 and 108 are spring clips 110 and 112 similar to clip 84 illustrated in FIGS. 8 and 9. The clips 110 and 112 completely encompass the housing 10 and are attached to the brackets 106 and 108, respectively, by either an adjustable mount or by direct attachment such as spot welding. The actual location of the housing 10 for illumination purposes is at the discretion of the user and the attachment of the clips 110 and 112 to brackets 106 and 108 will maintain this position.

Referring now to FIG. 11, there is shown a side view of bracket 108 holding clip 112 in a preferred position. In FIG. 11 the clip 112 is fixedly attached to the end portion of bracket 108 so as to maintain the housing 10 at a discrete angle sufficient to illuminate the goods on the lowermost shelf such as shelf 102 as illustrated in FIG. 10. For conventional size shelving it has been determined that an angle of 35 degrees between the bracket 108 and the housing 10 is considered preferable. It is a simple matter to locate the clip 112 with respect to bracket 108 at the fixed angle of 35 degrees or in fact any other angle may be chosen should different sized shelving be used.

Figure 12:
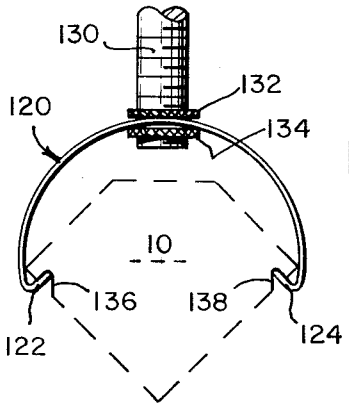
FIG. 12 illustrates an adjustable mounting clip for varying the position of the housing.
Figure 13:
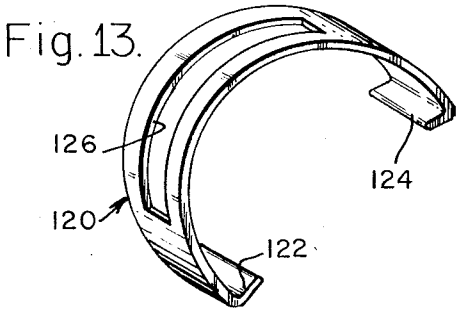
FIG. 13 illustrates a perspective view of the adjustable clip illustrated in FIG. 12.

Referring now to FIGS. 12 and 13, there is shown still another embodiment of a clip for holding housing 10 and in a variety of angles.

The clip 120 is semi-circular in cross-section and contains a pair of channels 122 and 124 adapted to fit into elongated grooves 36 and 38 located on housing 10. The clip 120 completely encircles the housing 10, thereby effectively holding the housing in a nesting relationship with the clip.

The clip contains an elongated slot 126 in the centermost portion for allowing a stud 130 to pass through and be attached to clip 120 at one end by means of nut 132 and at the other end by means of nut 134.

As shown in FIG. 12, the direction of the light emanating from the housing 10 is controlled by loosening nut 134 and sliding the assembly comprising the clip 120 and the housing 10 to any desired position as required by the user. Tightening the lock nut 134 maintains the position of the housing 10 in the new selected position thereby allowing the single clip 120 to be used rather than the fixed embodiments illustrated in FIGS. 8, 9, 10 and 11.

I claim:

1. A lighting fixture comprising:

an elongated housing of generally U-shaped cross-section, each arm of said U-shaped members comprising said housing having grooves extending longitudinally the length of said housing, at least one light module having an L-shaped cross-section member with two equal length arms adapted to nest within said U-shaped member of said housing in a holding relationship, said L-shaped member having a central cut-out for accepting a lamp and a lamp socket, at least one elongated concave reflector nesting within said U-shaped housing for placement adjacent said central cut-out in said L-shaped member, a removable elongated lens having a semi-circular cross-section located substantially over said central cut-out in said L-shaped member having end portions adapted to contacts at longitudinal grooves in said housing for completely encompassing said L-shaped member, and a clip having a semi-circular cross-section and channeled end portions for completely encompassing said lens and in which said channeled end portions are adapted to engage said longitudinal grooves in said U-shaped members for holding said lens in a removable relationship.

2. A lighting fixture according to claim 1 in which said housing is constructed of extruded aluminum.

3. A lighting fixture according to claim 1 in which the cross-section of said housing comprises five planer surfaces connected together to form a substantially U-shaped cross-section.

4. A lighting fixture according to claim 3 in which said five planer surfaces consist of a pair of identical right angle members each having a short side and a long side, each of said long sides connected to a common fifth side at 45 degrees with said short sides substantially facing each other.

5. A lighting fixture according to claim 4 which includes a pair of identical ribs located within said housing and each connected to said long sides of said pair of identical right angle members for strengthening said housing and providing a support for said elongated concave reflector.

6. A lighting fixture according to claim 1 which includes a plurality of light modules nesting within said housing.

7. A lighting fixture according to claim 6 which includes a plurality of concave reflectors, one for each light module.

8. A lighting fixture according to claim 1 in which said lamp is a low voltage halogen lamp adapted to operate on either 12 or 28 volts.

9. A lighting fixture according to claim 1 which includes a pair of clips, one located at each end portion of said elongated lens for holding said lens in said removable relationship.

10. A lighting fixture according to claim 1 in which said elongated lens has a length sufficient to cover said central cut-out in said L-shaped member.

11. A lighting fixture according to claim 10 which includes a plurality of different colored removable elongated lenses.

12. A lighting fixture according to claim 1 which includes at least one spring clip of generally U-shaped cross-section held in a contiguous relationship with the outside of said housing, said spring clip having channeled end portions for engaging said grooves located in said housing for positioning said housing in any desired position, said spring clip adapted to be mounted for supporting said lighting fixture.

13. A lighting fixture according to claim 3 which includes at least one spring clip comprising five planer surfaces, one for each side of said housing, forming a substantially U-shaped cross-section and held in a contiguous relationship with the outside of said housing, said clip having channeled end portions for engaging said grooves located in said housing for positioning said housing in any desired position, said clip adapted to be mounted to any fixed location for supporting said lighting fixture.

14. A lighting fixture according to claim 13 in which said spring clip is removably attached to a supporting member for holding said housing in a preferred position.

15. A lighting fixture according to claim 1 which includes at least one spring clip having a semi-circular cross-section and channeled end portions for completely encompassing said housing and in which said channeled end portions are adapted to engage said longitudinal grooves in said U-shaped member for holding said housing in a removable relationship.

16. A lighting fixture according to claim 15 in which said clip has an elongated slot adapted to movably support said housing in any selected position.

* * * * *